US007736246B2

(12) United States Patent
Lortscher

(10) Patent No.: US 7,736,246 B2
(45) Date of Patent: Jun. 15, 2010

(54) BASEBALL BAT SWING TRAINING AID

(76) Inventor: Lane Lortscher, 18037 Martha St., Encino, CA (US) 91316

( * ) Notice: Subject to any disclaimer, the term of this patent is extended or adjusted under 35 U.S.C. 154(b) by 0 days.

(21) Appl. No.: 11/306,984

(22) Filed: Jan. 18, 2006

(65) Prior Publication Data

US 2007/0167261 A1 Jul. 19, 2007

(51) Int. Cl.
*A63B 69/40* (2006.01)
*A63B 69/00* (2006.01)

(52) U.S. Cl. ..... 473/417; 473/422; D21/715

(58) Field of Classification Search ..... 473/417, 473/422, 431, 451, 387; 124/16, 17, 37
See application file for complete search history.

(56) References Cited

U.S. PATENT DOCUMENTS 2,527,906 A * 10/1950 Bennett et al. ..... 473/417
3,474,771 A * 10/1969 Breslow et al. ..... 124/16
3,952,477 A * 4/1976 Candor et al. ..... 53/452
4,176,838 A 12/1979 Griffin
5,672,124 A 9/1997 Pecoraro et al.
6,296,581 B1 * 10/2001 Sever ..... 473/422
6,413,175 B1 7/2002 Mooney, Jr.
6,565,459 B2 * 5/2003 Gormley ..... 473/423
6,682,445 B1 1/2004 Tanner
D509,551 S * 9/2005 Reynolds ..... D21/715
7,226,372 B2 * 6/2007 Flanigan ..... 473/417
7,255,658 B1 * 8/2007 VanKuiken et al. ..... 473/454
2006/0199672 A1 * 9/2006 Flanigan ..... 473/417

* cited by examiner

*Primary Examiner*—Mitra Aryanpour
(74) *Attorney, Agent, or Firm*—Kelly Lowry & Kelley, LLP

(57) ABSTRACT

A baseball bat swing training aid includes a housing having an inner cavity for storing a plurality of balls therein. A tube is extendable between storage and use configurations. The tube is disposed within the housing in the storage position. A ball holder is disposed on an end of the tube.

28 Claims, 6 Drawing Sheets

BASEBALL BAT SWING TRAINING AID

BACKGROUND OF THE INVENTION

The present invention generally relates to a device for aiding in the batting of a ball. More particularly, the present invention resides in a baseball bat swing training aid.

Devices for aiding in the training of a batting swing are generally known in the art. For example, U.S. Pat. No. 4,176,838 discloses a batting baseball tee. However, the disclosed tee is not collapsible for easy portability or storage of the tee. In another example, U.S. Pat. No. 5,672,124 discloses an automatic batting tee apparatus. However, the disclosed tee is not able to store balls within its housing. In a further example, U.S. Pat. No. 6,413,175 discloses a batting tee. However, the disclosed tee is bulky and not able to store balls. In yet another example, U.S. Pat. No. 6,682,445 discloses a durable batting tee. However, while the disclosed tee is collapsible, the tee is not capable of storing a number of balls.

Accordingly, there is a need for a baseball bat swing training aid that is not only collapsible, but able to store balls for use. There is a further need for a swing training aid that is not only portable, but also compact for storage. There is an additional need for a training aid that is easily movable between storage and use configurations, and that relies on minimal support for maintaining an upright configuration. There is a further need for a swing training aid that is economical and easy to manufacture. The present invention fulfills these needs and provides other related advantages.

SUMMARY OF THE INVENTION

The present invention resides in a baseball bat swing training aid assembly that is easily movable between storage and use configurations, providing a baseball bat swing training aid assembly that is not only collapsible and portable, but also able to store balls yet in a manner that is still compact for storage. The baseball bat swing training aid assembly has a simplified structure for maintaining the swing training aid in an upright configuration.

The present invention discloses a baseball bat swing training aid including a housing having an inner cavity for storing a plurality of balls therein. A tube is extendable between storage and use configurations. The tube is disposed within the housing in the storage configuration. A ball holder is disposed on an end of the tube. The housing includes a handle.

The baseball bat swing training aid includes a lid covering the inner cavity of the housing. The lid includes an aperture through which the tube is movable between the storage and use configurations.

The tube includes a telescoping extension selectively movable between a retracted position and an extended position. The telescoping extension is selectively movable to a position intermediate the retracted and extended positions. The tube is connected to an interior of the housing.

In one embodiment, the ball holder includes a spring connected to the end of the tube. The ball holder is disposed above the housing in the storage configuration.

In another embodiment, the ball holder pivots between storage and use configurations, with the ball holder automatically pivoting from the storage to the use configuration. The ball holder is resiliently connected to the end of the tube.

The housing includes an open end which permits access to the inner cavity. The balls are individually removable from the housing through the open end.

Other features and advantages of the present invention will become apparent from the following more detailed description, taken in conjunction with the accompanying drawings which, by way of example, illustrate the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
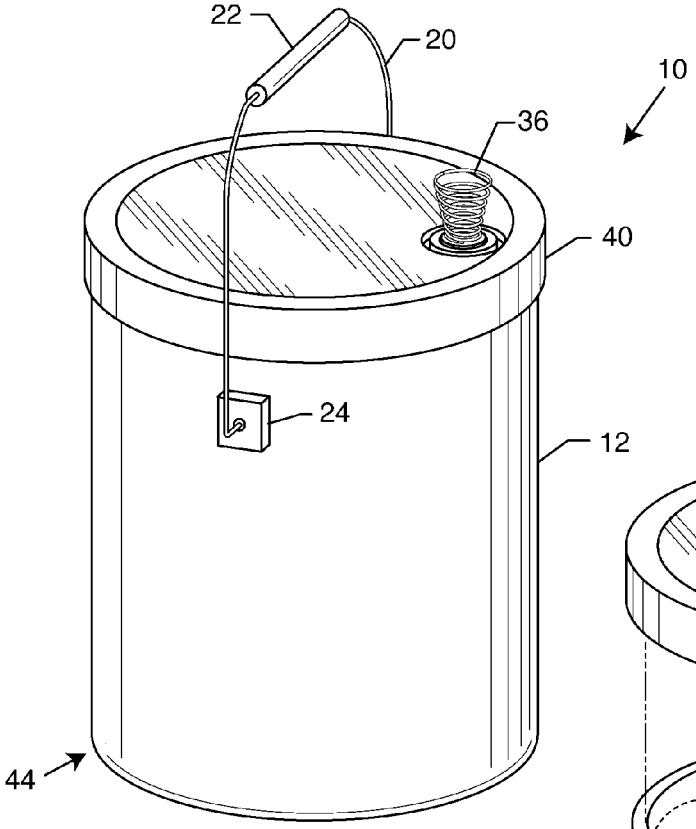
FIG. 1 is a perspective view of a baseball bat swing training aid embodying the present invention, shown in a collapsed, storage configuration.
Figure 2:
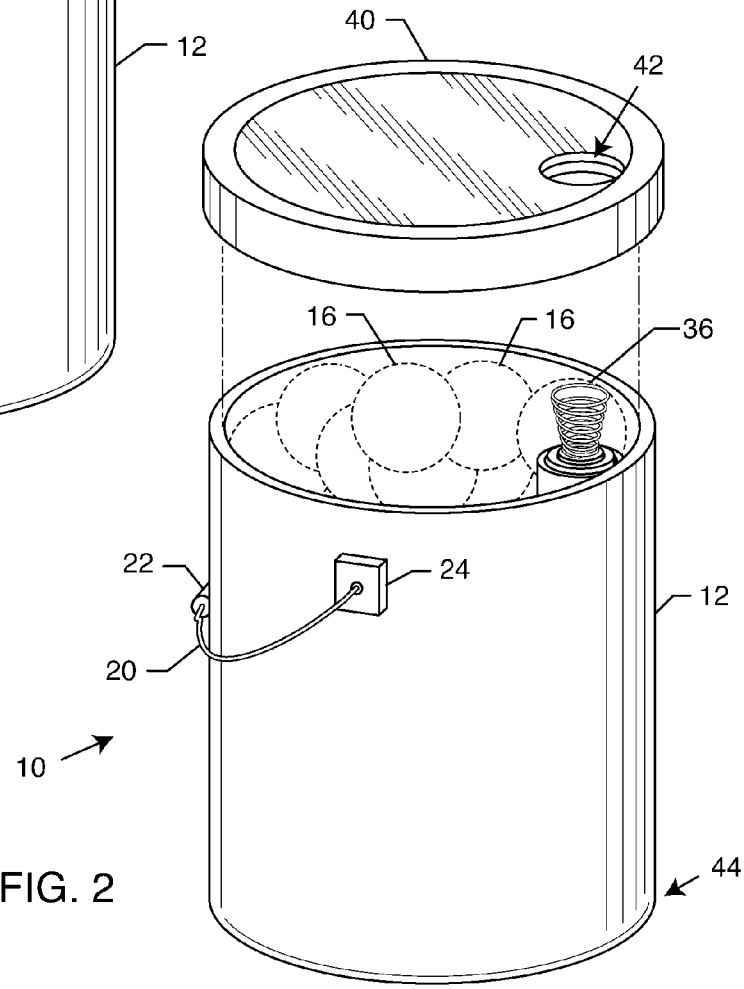
FIG. 2 is a perspective, cross-sectional view of the training aid of FIG. 1 shown with a lid removed to reveal baseballs stored within an interior of a housing.
Figure 3:
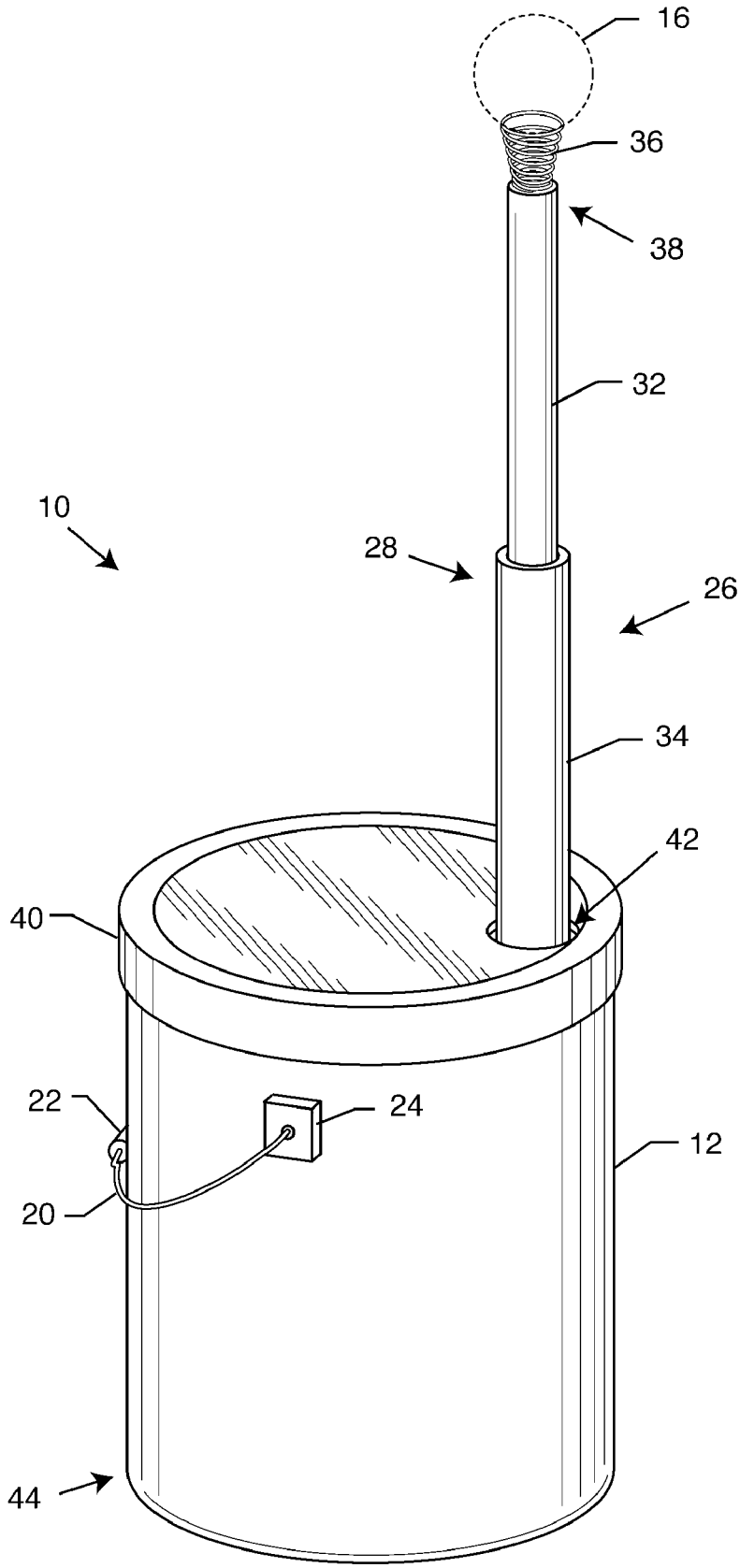
FIG. 3 is a perspective view of the training aid of FIG. 1 shown with a tube assembly in an extended position and with a ball mounted on a ball holder at an end of the tube.
Figure 4:
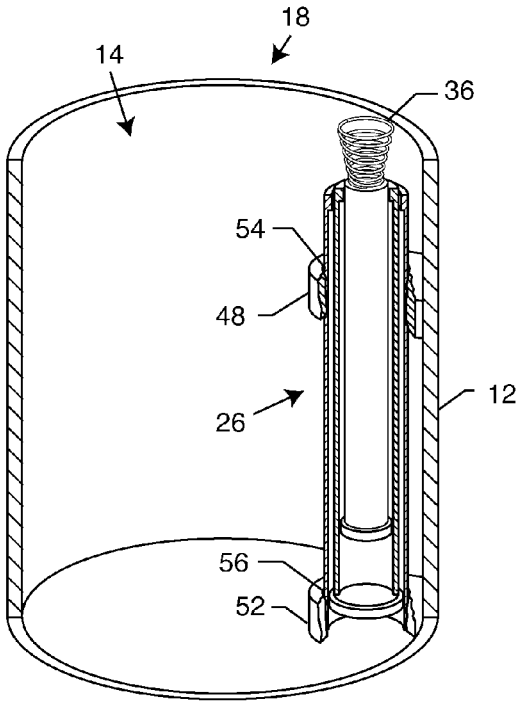
FIG. 4 is a cross-sectional, perspective view of the training aid of FIG. 1 revealing the interior of the housing and the interior of the tube assembly.
Figure 6:
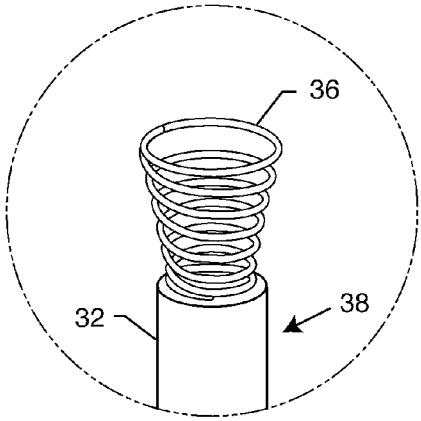
FIG. 6 is an exploded view of the ball holder, taken along line 6-6 of FIG. 2.
Figure 5:
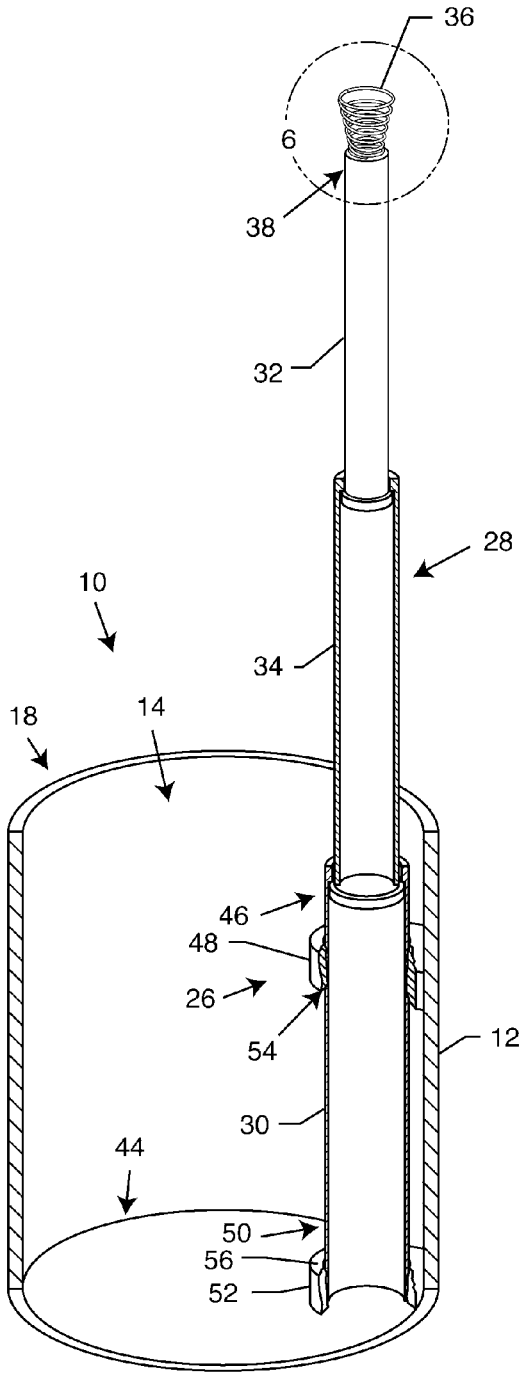
FIG. 5 is a cross-sectional, perspective view of the training aid of FIG. 1 revealing the interior of the housing and the interior of the tube assembly shown in the extended position.

As shown in the drawings for purposes of illustration, the present invention discloses a portable, collapsible baseball bat swing training aid 10, 60 as seen in FIGS. 1-12.

As seen in FIGS. 1-6, a first embodiment of the baseball bat swing training aid 10 includes a housing 12 having an inner cavity 14 for storing a plurality of balls 16, in the form of baseballs, therein. The housing 12 also includes an open end 18 which permits access to the inner cavity 14. The balls 16 are individually removable from the housing 12 through the open end 18. Other balls 16 that may be used include softballs, tennis balls, wiffle balls or the like.

The housing 12 further includes a pivotal handle 20 connected to an exterior surface of the housing 12. The handle 20 is pivotally connected to the housing 12 such that the handle 20 can pivot relative to the housing 12 over the open end 18 of the housing 12. The handle 20 comes in various forms including, but not limited to, a wire handle with a grip section 22 (shown in FIGS. 1 and 2) that is similar, if not identical to, the kind of handle commonly found on conventional paint cans. The housing 12 includes a pair of attachment members 24

(only one of which is seen in the figures). Each end of the handle 20 extends into a respective attachment member 24, where the end of the handle 20 is held in place, to make the pivotal connection between the handle 20 and the housing 12, in a manner similar, if not identical to, the way handles are pivotally connected to conventional paint cans.

A tube assembly 26 is connected to an interior of the housing 12. The tube assembly 26 is extendable between storage and use configurations. The tube assembly 26 is generally disposed within the inner cavity 14 of the housing 12 in the storage configuration. The tube assembly 26 includes a telescoping extension section 28 including a lower tube portion 30, an upper tube portion 32 and an intermediate tube portion 34 disposed therebetween. The extension section 28 allows the tube assembly 26 to be selectively movable between at least a completely retracted position and a fully extended position. The telescoping extension 28 also allows the tube assembly 26 to be selectively movable to a position intermediate the retracted and extended positions. The upper tube portion 32 is slidably receivable within the intermediate tube portion 34. Likewise, the intermediate tube portion 34 is slidably receivable within the lower tube portion 30. The tube portions 30, 32, 34 are held in position relative to each other by press-fit engagement. In this manner, the intermediate tube portion 34 may be moved between retracted and extended positions relative to the lower tube portion 30 and the upper tube portion 30 may be moved between retracted and extended positions relative to the intermediate tube portion 32. The lower tube portion 30 is secured to the interior of the housing 12 on an upper end 46 by a mounting member 48 extending from the interior side surface of the housing 12 and on a lower end 50 by a mounting member 52 extending upwardly from a base 44 of the housing 12. The lower portion 30 press-fit engages a bore 54 extending through the mounting member 48 and a bore 56 extending through the mounting member 52.

In the alternative, a locking mechanism (not shown) holds and/or releases the upper tube portion 32 to move relative to the intermediate tube portion 34, between retracted and extended positions. Likewise, a locking mechanism (not shown) holds and/or releases the intermediate tube portion 34 to move relative to the lower tube portion 30, between retracted and extended positions. Each locking mechanism could use a turnable knob connected to a threaded shank that extends through a threaded bore (not shown) in the intermediate 34 and lower 30 tube portions, respectively. An end of the threaded shank of each locking mechanism abuts against a respective tube portion 32, 34 when the knob is turned in one direction to lock the tube portion 32, 34 in place relative to the respective tube portion 34, 30 from which the tube portion 32, 34 moves relative to. Turning the knob in the other direction releases the tube portions 32, 34 to telescopically move relative to their respective tube portions 34, 30. In another alternative, each locking mechanism could include a cylindrical post connected to a bent flexible member located within the tube portion 32, 34. Each post, respectively, extends through an aperture on a side of the upper and intermediate tube portions 32, 34. The post extends through an aperture(s) located at a fixed point(s) on the tube portion 34, 30. If the tube assembly 26 is in the extended position, a user can retract the retracted position by depressing the post extending through the aperture on the tube portion 34, 30. Once the post enters the tube portion 34, 30, the interior surface of the respective tube portion 34, 30 maintains the post in a depressed position. However, once the post becomes coaxial with one of the apertures of the tube portion 34, 30, the force of the flexible member pushes the post through the aperture the post is aligned with, locking the tube assembly 26 in position. If the user desires to move the tube assembly 26 into a fully retracted position within the housing 12, the user can depresses the post(s), disengaging the lock(s), and push the tube portions 32, 34 towards the housing 12 until the tube portions 32, 34 can go no further.

A ball holder 36 is disposed on an end 38 of the upper portion 32 of the extension section 28 of the tube assembly 26. The ball holder 36 may come in various forms including, but not limited to, an inverted conical helical spring connected to the end 38 of the upper tube portion 32 of the tube assembly 26. The ball holder 36 is disposed above the housing 12 in the storage configuration.

The baseball bat swing training aid 10 includes a lid 40 covering the open end 18 of the housing and limiting access to the inner cavity 14 of the housing 12. The lid 40 includes an aperture 42 through which the extension section 28 of the tube assembly 26 is movable between the storage and use configurations. The ball holder 36 extends above the lid 40 when the tube assembly 26 is completely retracted in the storage configuration. The diameter of the aperture 42 is larger than the exterior diameter of the intermediate portion 34 of the extension section 26 and/or the exterior diameter of the ball holder 36. This allows the lid 40 to be lifted off the housing 12 without interference from the tube assembly 26 or the ball holder 36.

The weight of the balls 16 filling the inner cavity 14 of the housing 12 is sufficient to prevent the housing 12 from tipping over during use and/or the base 44 of the housing 12 may be sufficiently weighted so as to prevent the baseball bat swing training aid 10 from tipping over when in use. In an alternative, the housing 12 may include a sharp, pointed stake extending from the bottom of the base 44 of the housing 12 in order to secure the baseball bat swing training aid 10 to the ground during use by driving the stake into the ground deep enough to prevent the housing 12 from tipping over during use.

As seen in FIGS. 7-12, another embodiment of the baseball bat swing training aid 60 includes a housing 62 having an inner cavity 64 for storing a plurality of balls 66, in the form of baseballs, therein. The housing 62 also includes an open end 68 which permits access to the inner cavity 64. The balls 66 are individually removable from the housing 62 through the open end 68. Other balls 66 that may be used include softballs, tennis balls, wiffle balls or the like.

Figure 7:
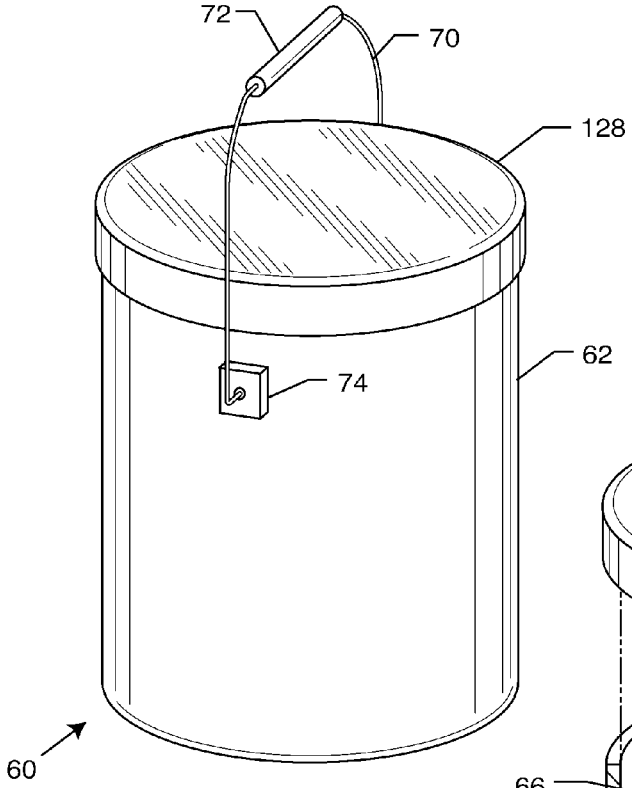
FIG. 7 is a perspective view of another baseball bat swing training aid embodying the present invention, shown in a collapsed, storage configuration.
Figure 8:
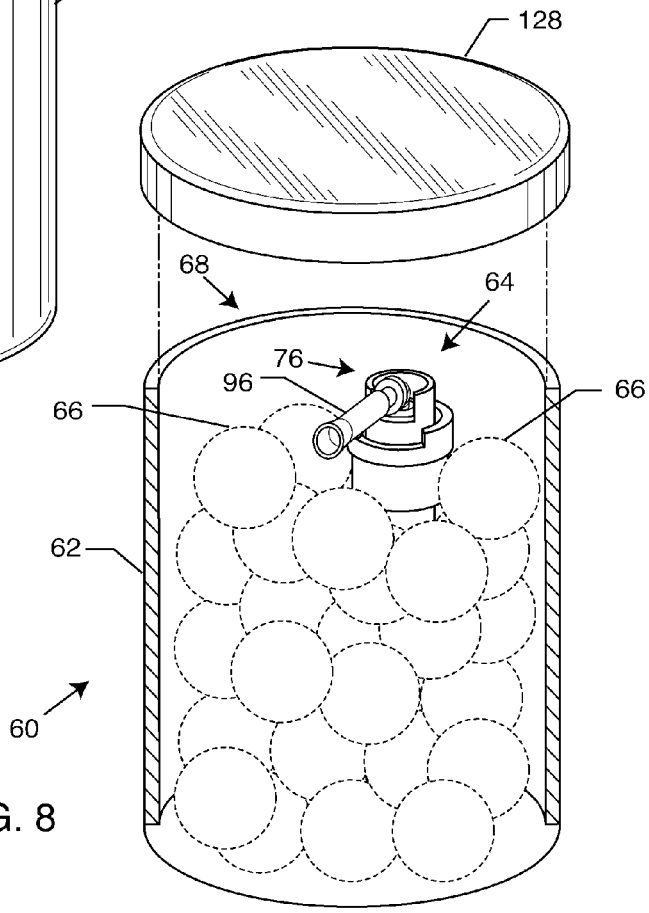
FIG. 8 is a perspective, cross-sectional view of the training aid of FIG. 7 shown with a lid removed to reveal baseballs stored within an interior of a housing, and a ball holder in the storage configuration.
Figure 9:
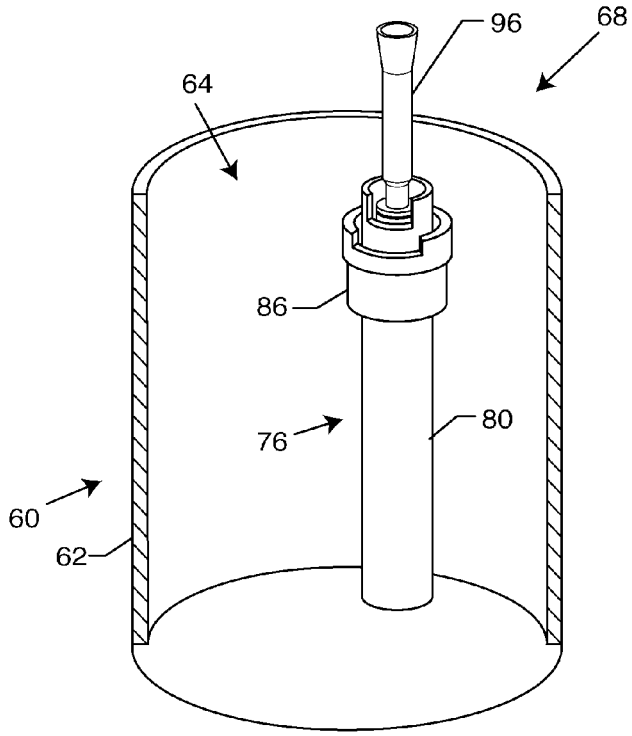
FIG. 9 is a cross-sectional, perspective view of the training aid of FIG. 7 revealing the interior of the housing.
Figure 10:
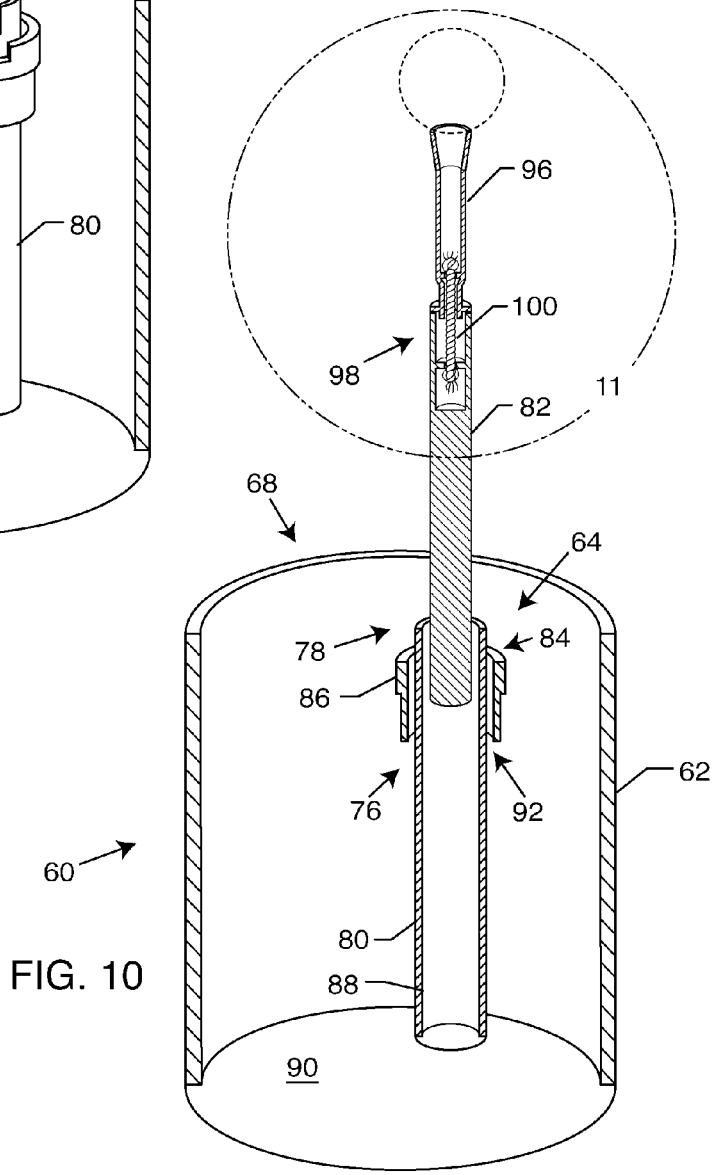
FIG. 10 is a cross-sectional, perspective view of the training aid of FIG. 7 revealing the interior of the housing and the interior of the tube assembly shown in the extended position.
Figure 11:
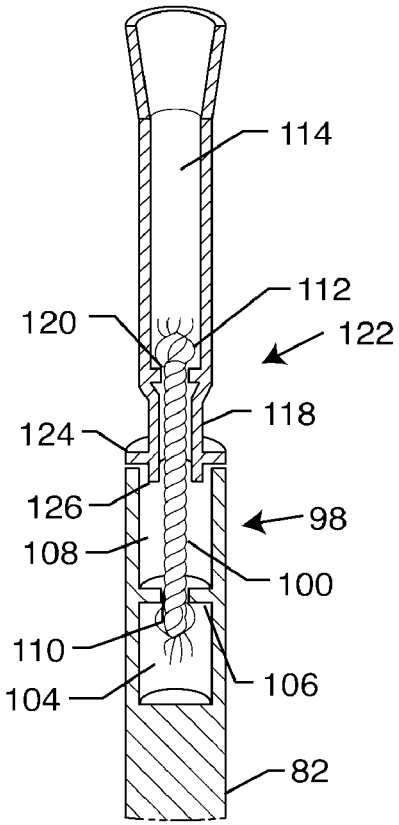
FIG. 11 is an exploded view of the ball holder, taken along line 11-11 of FIG. 10, with the ball holder in the use configuration.
Figure 12:
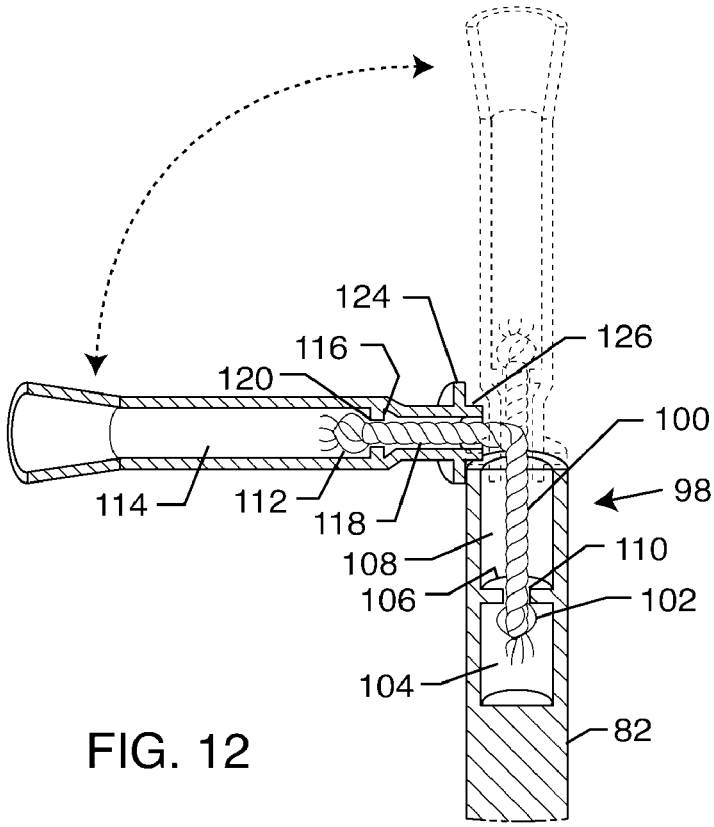
FIG. 12 is an exploded view of the ball holder FIG. 11, showing the movement of the ball holder between use and storage configurations.

The housing 62 further includes a pivotal handle 70 connected to an exterior surface of the housing 62. The handle 70 is pivotally connected to the housing 62 such that the handle 70 can pivot relative to the housing 62 over the open end 68 of the housing 62. The handle 70 comes in various forms including, but not limited to, a wire handle with a grip section 72 (shown in FIG. 7) that is similar, if not identical to, the kind of handle commonly found on conventional paint cans. The housing 62 includes a pair of attachment members 74 (only one of which is seen in FIG. 7). Each end of the handle 70 extends into a respective attachment member 74, where the end of the handle 70 is held in place, to make the pivotal connection between the handle 70 and the housing 62, in a manner similar, if not identical to, the way handles are pivotally connected to conventional paint cans.

A tube assembly 76 is connected to an interior of the housing 62. The tube assembly 76 is extendable between storage and use configurations. The tube assembly 76 is generally disposed within the inner cavity 64 of the housing 62 in the storage configuration. The tube assembly 76 includes a telescoping extension section 78 including a lower tube portion 80 and an upper tube portion 82. The extension section 78 allows the tube assembly 76 to be selectively movable between at least a completely retracted position and a fully extended position. The telescoping extension 78 also allows the tube assembly 76 to be selectively movable to a position intermediate the retracted and extended positions. The upper tube portion 82 is slidably receivable within the lower tube portion 80. The tube portions 80, 82 are held in position relative to each other by press-fit engagement. In this manner, the upper tube portion 82 may be moved between retracted and extended positions relative to the lower tube portion 80. The lower tube portion 80 is secured to the interior of the housing 62 on an upper end 84 by a mounting member 86 extending from the interior side surface of the housing 62. A lower end 88 of the lower tube portion 80 is in contact with a base 90 of the housing 62. The lower tube portion 80 press-fit engages a bore 92 extending through the mounting member 86.

In the alternative, a locking mechanism (not shown) holds and/or releases the upper tube portion 82 to move relative to the lower tube portion 80, between retracted and extended positions. The locking mechanism could use a turnable knob connected to a threaded shank that extends through a threaded bore (not shown) in the lower tube portion 80. An end of the threaded shank of the locking mechanism abuts against the upper tube portion 82 when the knob is turned in one direction to lock the upper tube portion 82 in place relative to the lower tube portion 80 from which the upper tube portion 82 moves relative to. Turning the knob in the other direction releases the upper tube portions 82 to telescopically move relative to the lower tube portion 80. In another alternative, the locking mechanism could include a cylindrical post connected to a bent flexible member located within the upper tube portion 82. The post extends through an aperture on a side of the upper tube portion 82. In use, the post also extends through an aperture(s) located at a fixed point(s) on the lower tube portion 80. If the tube assembly 76 is in the extended position, a user can retract the retracted position by depressing the post extending through the aperture on the lower tube portion 80. Once the post enters the lower tube portion 80, the interior surface of the lower tube portion 80 maintains the post in a depressed position. However, once the post becomes coaxial with one of the apertures of the lower tube portion 80, the force of the flexible member pushes the post through the aperture the post is aligned with, locking the tube assembly 76 in position. If the user desires to move the tube assembly 76 into a fully retracted position within the housing 62, the user can depresses the post(s), disengaging the lock(s), and push the upper tube portion 82 towards the housing 62 until the upper tube portion 82 can go no further.

A ball holder 96 is disposed on an end 98 of the upper tube portion 82 of the extension section 78 of the tube assembly 76. The ball holder 96 may come in various forms including, but not limited to, a cylindrical tube having an inverted conical end where the ball holder 96 is resiliently connected to the end 98 of the upper tube portion 82 of the tube assembly 76 by a flexible cord 100 that comes in various forms including, without limitation, a bungee cord or the like. A first knotted end 102 of the cord 100 is held within a lower compartment 104 of the end 98 of the upper tube portion 82 by a dividing wall 106 between the lower compartment 104 and an upper compartment 108 of the end 98 of the upper tube portion 82. The cord 100 extends through an aperture 110 in the dividing wall 106, with the smaller diameter of the aperture 110 preventing the larger diameter of the first knotted end 102 from passing into the upper compartment 108. A second knotted end 112 of the cord 100 is held within an upper compartment 114 of the ball holder 96 by a dividing wall 116 between the upper compartment 114 and a lower compartment 118 of the ball holder 96. The cord 100 extends through an aperture 120 in the dividing wall 116, with the smaller diameter of the aperture 120 preventing the larger diameter of the second knotted end 112 from passing into the lower compartment 118. The flexible cord 100 allows the ball holder 96 to bend/pivot with respect to the upper tube portion 82. A lower end 122 of the ball holder 96 includes an annular ring 124 and a cylindrical guide 126 that extends into the upper compartment 108 of the upper tube portion 82 in the use configuration. In the use configuration, the annular ring 124 abuts against the end 98 of the upper tube portion 82 and prevents the ball holder 96 from further movement into the upper compartment 108 of the upper tube portion 82. The ball holder 96 is disposed within the housing 62 in the storage configuration, with the ball holder 96 bent/pivoted with respect to the upper tube portion 82. The resilience/flexibility of the cord 100 allows the ball holder 96 to automatically pivot from the storage to the use configuration, where the ball holder 96 is aligned with the upper tube portion 82, with the cord 100 literally pulling the ball holder 96 and upper tube portion 82 into alignment.

The baseball bat swing training aid 60 includes a lid 128 covering the open end 68 of the housing and limiting access to the inner cavity 64 of the housing 62.

The weight of the balls 66 filling the inner cavity 64 of the housing 62 is sufficient to prevent the housing 62 from tipping over during use and/or the base 90 of the housing 62 may be sufficiently weighted so as to prevent the baseball bat swing training aid 60 from tipping over when in use. In an alternative, the housing 62 may include a sharp, pointed stake extending from the bottom of the base 90 of the housing 62 in order to secure the baseball bat swing training aid 60 to the ground during use by driving the stake into the ground deep enough to prevent the housing 62 from tipping over during use.

While the baseball bat swing training aid 10, 60 has been described in the context of baseball, the training aid 10, 60 is equally applicable in the context of softball, wiffle ball or the like.

The above-described embodiments of the present invention are illustrative only and not limiting. It will thus be apparent to those skilled in the art that various changes and modifications may be made without departing from this invention in its broader aspects.

What is claimed is:

1. A baseball bat swing training aid, comprising:

a housing having an inner cavity for storing a plurality of balls therein;

a selectively extendable tube disposed within the housing, wherein the tube resides within the housing when in a storage configuration;

a vertical support coupling the tube to a sidewall of the housing, the vertical support and the tube positioned in the housing to provide obstruction-free access to the balls in the inner cavity during use; and a ball holder disposed on an end of the tube.

2. The swing training aid of claim 1, including a lid covering the inner cavity of the housing.

3. The swing training aid of claim 2, wherein the lid includes an aperture through which the tube is selectively extendable.

4. The swing training aid of claim 1, wherein the housing includes a handle.

5. The swing training aid of claim 1, wherein the tube includes a telescoping extension selectively movable between a retracted position and an extended position.

6. The swing training aid of claim 5, wherein the telescoping extension is selectively movable to a position intermediate the retracted and extended positions.

7. The swing training aid of claim 1, wherein the ball holder comprises a spring connected to the end of the tube.

8. The swing training aid of claim 1, wherein the ball holder is disposed above the housing in the storage configuration.

9. The swing training aid of claim 1, wherein the ball holder pivots between storage and use configurations.

10. The swing training aid of claim 9, wherein the ball holder automatically pivots from the storage configuration to the use configuration.

11. The swing training aid of claim 9, wherein the ball holder is resiliently connected to the end of the tube.

12. The swing training aid of claim 1, wherein the housing includes an open end which permits access to the inner cavity, the balls being individually removable from the housing through the open end.

13. A baseball bat swing training aid, comprising:

a housing having an inner cavity for storing a plurality of balls therein;

a selectively extendable tube, disposed within the housing and including a telescoping extension selectively movable between a retracted position and an extended position, wherein the tube resides completely within the housing when in a storage configuration;

a vertical support coupling the tube to a sidewall of the housing, the vertical support and the tube positioned in the housing to provide obstruction-free access to the balls in the inner cavity during use;

a ball holder disposed on an end of the tube; and a lid covering the inner cavity of the housing.

14. The swing training aid of claim 13, wherein the lid includes an aperture through which the tube is selectively extendable.

15. The swing training aid of claim 13, wherein the housing includes a handle.

16. The swing training aid of claim 13, wherein the telescoping extension is selectively movable to a position intermediate the retracted and extended positions.

17. The swing training aid of claim 13, wherein the ball holder comprises a spring connected to the end of the tube and disposed above the housing when the tube is in the storage configuration.

18. The swing training aid of claim 13, wherein the ball holder pivots between storage and use configurations.

19. The swing training aid of claim 18, wherein the ball holder automatically pivots from the storage configuration to the use configuration.

20. The swing training aid of claim 18, wherein the ball holder is resiliently connected to the end of the tube.

21. The swing training aid of claim 13, wherein the housing includes an open end which permits access to the inner cavity, the balls being individually removable from the housing through the open end.

22. A baseball bat swing training aid, comprising:

a housing having an open end which permits access to an inner cavity of the housing for storing a plurality of balls therein, the balls being individually removable from the housing through the open end;

a selectively extendable tube disposed within the housing, wherein the tube includes a telescoping extension selectively movable between a retracted position and an extended position and resides completely within the housing when in a storage configuration;

a vertical support coupling the tube to a sidewall of the housing, the vertical support and the tube positioned in the housing to provide obstruction-free access to the balls in the inner cavity during use;

a ball holder disposed on an end of the tube; and a lid covering the open end of the housing.

23. The swing training aid of claim 22, wherein the housing includes a handle.

24. The swing training aid of claim 22, wherein the lid includes an aperture through which the tube is selectively extendable.

25. The swing training aid of claim 22, wherein the ball holder comprises a spring connected to the end of the tube and disposed above the housing when the tube is in the storage configuration.

26. The swing training aid of claim 22, wherein the ball holder pivots between storage and use configurations.

27. The swing training aid of claim 26, wherein the ball holder automatically pivots from the storage configuration to the use configuration.

28. The swing training aid of claim 26, wherein the ball holder is resiliently connected to the end of the tube.

* * * * *